United States Patent [19]

Hemala et al.

[11] 4,080,776

[45] Mar. 28, 1978

[54] THREADING DEVICE FOR DOUBLE TWIST THREAD TWISTING FRAMES

[75] Inventors: Zdenek Hemala; Günter Nudinger, both of Kempten; Gerhard Wehrmeister, St. Mang; Reinhard Mair, Waltenhofen; Erich Wurster, Memmingen, all of Germany

[73] Assignee: Saurer-Allma GmbH Allgauer Maschinenbau, Kempten, Germany

[21] Appl. No.: 727,150

[22] Filed: Sep. 27, 1976

[30] Foreign Application Priority Data

Oct. 4, 1975 Germany ..... 7531564[U]

[51] Int. Cl.[2] ..... D01H 15/00; D01H 1/10

[52] U.S. Cl. ..... 57/34 R; 57/58.83

[58] Field of Search ..... 57/34 R, 34.5, 58.49, 57/58.7, 58.87, 58.86, 106

[56] References Cited

U.S. PATENT DOCUMENTS

| | | | |
|---|---|---|---|
| 2,675,908 | 4/1954 | Griset, Jr. | 57/34.5 X |
| 2,681,729 | 6/1954 | Griset, Jr. | 57/34.5 X |
| 2,715,308 | 8/1955 | Soussloff et al. | 57/58.7 X |
| 3,430,428 | 3/1969 | Asami et al. | 57/34.5 X |
| 3,452,626 | 7/1969 | Speakman | 57/34.5 X |
| 3,475,891 | 4/1969 | Matsuoka et al. | 57/34.5 X |
| 3,482,387 | 12/1969 | Slack | 57/34.5 X |
| 3,511,041 | 5/1970 | Korikovsky et al. | 57/34 R |
| 3,552,111 | 1/1971 | Treus et al. | 57/58.49 |
| 3,563,019 | 2/1971 | Greive et al. | 57/58.49 X |
| 3,731,478 | 5/1973 | Franzen | 57/34 R X |

*Primary Examiner*—John Petrakes

*Attorney, Agent, or Firm*—Blanchard, Flynn, Thiel, Boutell & Tanis

[57] ABSTRACT

A threading device for double twist thread twisting frames which have a spindle and a suction device movable toward a storage disc on the frame. A service carriage is movably mounted on the frame along one side thereof. A threading head is movably mounted on the service carriage and is movable between a rest position remote from the spindle and a threading position in which it is in registry with the upper end of the spindle. The threading head has on its side facing the spindle axis an inlet slot that extends parallel to the spindle axis. A thread channel is provided adjacent the bottom of the inlet slot and, in the threading position of the threading head, is in registry with the spindle axis. At least two holder elements are mounted on the frame and are spaced one above the other and substantially in the plane of movements of the inlet slot on the threading head. A piece of thread extends between the two holder elements and presents same to the threading head upon movement thereof toward the threading position.

15 Claims, 3 Drawing Figures

THREADING DEVICE FOR DOUBLE TWIST THREAD TWISTING FRAMES

FIELD OF THE INVENTION

The invention relates to a threading device for double twist thread twisting frames, having a suction device which is movable along the storage disc of the frame.

BACKGROUND OF THE INVENTION

In double twist twisting frames, the threads to be twisted must be threaded from the stationary supply bobbin, through the hollow spindle to the storage disc and in the latter they must be threaded radially outwardly. For this purpose a threading device of the type mentioned initially is known (from German Auslegeschrift 1,289,470) in which the suction device consists of a shaped member which can be applied to the storage disc and in which an injector nozzle is arranged. By means of this injector nozzle there is created at the opening of the storage disc a vacuum which is effective through the hollow spindle as far as the upper opening thereof. If thread breakage occurs between the supply bobbin and the storage disc, or if a thread has to be freshly threaded through the hollow spindle, in the first place the shaped member must be moved upwards of the storage disc. This can be effected by providing in the region of each spindle a shaped member which is pivotal about a horizontal axis, or by constructing the shaped member as a hand instrument which is carried by an attendant from spindle to spindle. After the shaped member has been applied to the storage disc, the compressed air is turned on so that the vacuum referred to is created at the upper end of the spindle. At this instant the attendant must hold the end of the thread to be threaded at the upper opening so that the end of the thread is sucked into the spindle. Previously or simultaneously, however, the attendant must draw a suitably long length of thread from the supply bobbin and hold it in order that this length of thread may be sucked into the hollow spindle with the least possible resistance. The suction effect at the upper end of the hollow spindle is relatively small owing to the flow losses occurring through the long and narrow hollow spindle. It is however particularly disadvantageous that the attendant has to remain at the spindle for a long time, during the whole of the threading operation. Also, the said suction devices have to be provided at each spindle if one attendant is not to have to carry a hand instrument from spindle to spindle, which is likewise laborious and time consuming.

Threading devices driven by compressed air are also known (from French Pat. No. 1,045,449) which also have to be carried about by an attendant. These have a blower nozzle and a mouthpiece adjoining the nozzle. The mouthpiece, which can be placed on the upper end of the hollow spindle, has a slot at its rim facing the spindle. The thread is sucked into this slot by the injector effect of the blower nozzle and is then conveyed through the spindle by the current of blowing air. In this case also the attendant must remain at the spindle during the whole of the threading operation and draw the piece of thread to be threaded from the supply bobbin, apply it to the mouthpiece and guide it during the threading operation.

The invention is based on the problem of providing a threading device of the type mentioned initially which to a great extent automatically performs the actual threading of the thread, is simple in construction and with which an attendant does not have to be present either at the beginning of the threading operation or during the threading operation at the particular twisting point. In accordance with the invention this is achieved in that there is provided, on a service carriage which is known in itself and is movable along at least one side of a frame, a threading head driven by compressed air which is movable from a rest position in which it is spaced from the spindle into a threading position in which it registers with the upper end of the spindle or with the opening of a thread brake arranged there, the threading head having, at the end facing the spindle axis, a threading slot that extends parallel to the spindle axis, which slot reaches as far as a thread channel provided in the threading head and registering in threading position with the spindle axis, and in that there are arranged on the frame in the region of each spindle at least two holder elements spaced one above the other and substantially in the plane of movement of the threading slot, between which elements the thread to be threaded can be hung and hence can be presented to the threading head.

By means of this novel threading device largely automatic threading of the thread through the spindle and storage disc is possible without an attendant having to be present at the beginning of the threading operation or during this operation. If the attendant notices a breakage of thread between the supply bobbin and the storage disc, or if the thread is to be threaded anew into a spindle, he has only to draw a length of thread from the supply bobbin and hang this length of thread on the two holder elements. He can then immediately proceed to the next spindle to be serviced or perform other work. The attendant does not need to present the end of the thread to the upper end of the hollow spindle and also he does not need to guide the thread until it is threaded through the hollow spindle and the storage disc. To this extent the attendant's work is reduced to a minimum and indeed to manual operations that are very easy to perform. The presented thread is, at a suitable time, when the service carriage has reached the spindle concerned and has come to a standstill, engaged by the threading head provided on the service carriage and brought over the upper end of the spindle, the suction device being simultaneously moved into the vicinity of the storage disc. Thereupon the thread to be threaded can be threaded through the spindle and the storage disc under the blowing action of the threading head and the suction of the suction device. Since the suction device and the threading head are carried along with the service carriage, only one of these devices needs to be provided, viz. not one for each spindle. Moreover, since the service carriage carries other assemblies for the performance of other work such for example as threading and conveying away the end of the thread hanging from the storage disc, or knotting, the threading device according to the invention does not involve any additional expenditure on manufacture or servicing as regards the service carriage. It is further of advantage to provide a shears that can be inserted into the region between the two holder elements and in the vicinity of the lower holder element. The distance of the shears from the upper holder element is such that the end of the thread to be threaded is located closely over the upper end of the spindle when the threading head has moved into its operative position and has engaged the thread to be threaded. The shears also ensures that the threading head always receives a predetermined length of thread independently of what length of thread was actually drawn from the supply bobbin by the attendant and presented.

Most double twist twisting frames have thread brakes arranged in the hollow spindle, the braking members (balls or the like) can be brought away from the coacting brake rings for the purpose of threading. This cutting out of the thread brakes is generally effected by exerting an axial, downwardly directed pressure on the upper end of the spindle. A further form of the invention will also permit the threading of a spindle equipped with such thread brakes without an attendant. This is achieved by providing on the threading head a downwardly movable slide which in the operative position of the threading head coacts with the thread brake provided on the spindle. When the threading head has reached its operative position, this slide is moved downwardly and presses on the upper end of the spindle or of a thread brake located on the spindle. In this way the thread brake is cut out and a passage for threading is freed through the thread brake. In the case of thread brakes that are cut out by pulling a part of the thread brake upwards, the slide must be so constructed that it engages and lifts this part to be lifted upwardly.

BRIEF DESCRIPTION OF THE DRAWINGS

The invention is explained below in more detail with reference to a practical example illustrated in the drawings.

DETAILED DESCRIPTION

Figure 1:
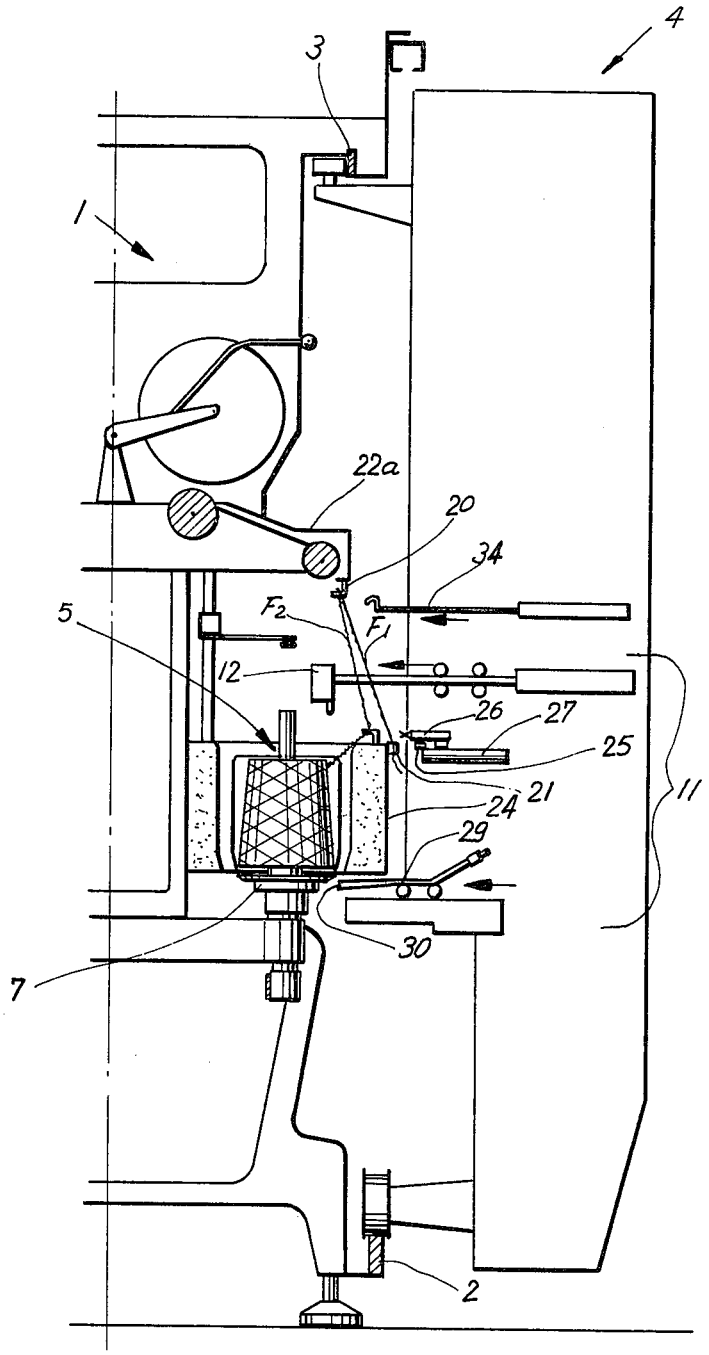
FIG. 1 shows a partial section through a double twist twisting frame with a service carriage and the threading device mounted thereon.

In the drawing, a double twist twisting frame is indicated at 1. The service carriage 4, which is guided on rails 2 and 3, can travel along the longitudinal side of the frame. The service carriage 4 may have, in addition to the threading device according to the invention, further threading devices, knotting devices and the like. In a known manner the double twist twisting frame 1 has a hollow spindle with a thread brake 6 provided at its upper end and a storage disc 7 provided at the lower end of the hollow spindle. This storage disc has an opening 8 at its periphery. The thread brake 6 has at its upper end an opening 9. If the spindle does not have a thread brake, this is generally replaced by a thread inlet which likewise has an upper opening and is connected to the hollow spindle. A thread drawn from the supply bobbin 10 must now be guided into the upper opening of the thread brake 6, then threaded through the hollow spindle 5 and the storage disc 7, until it emerges again at the opening 8 of the storage disc. For this purpose there serves the threading device arranged on the service carriage 4 and indicated generally at 11.

Figure 2:
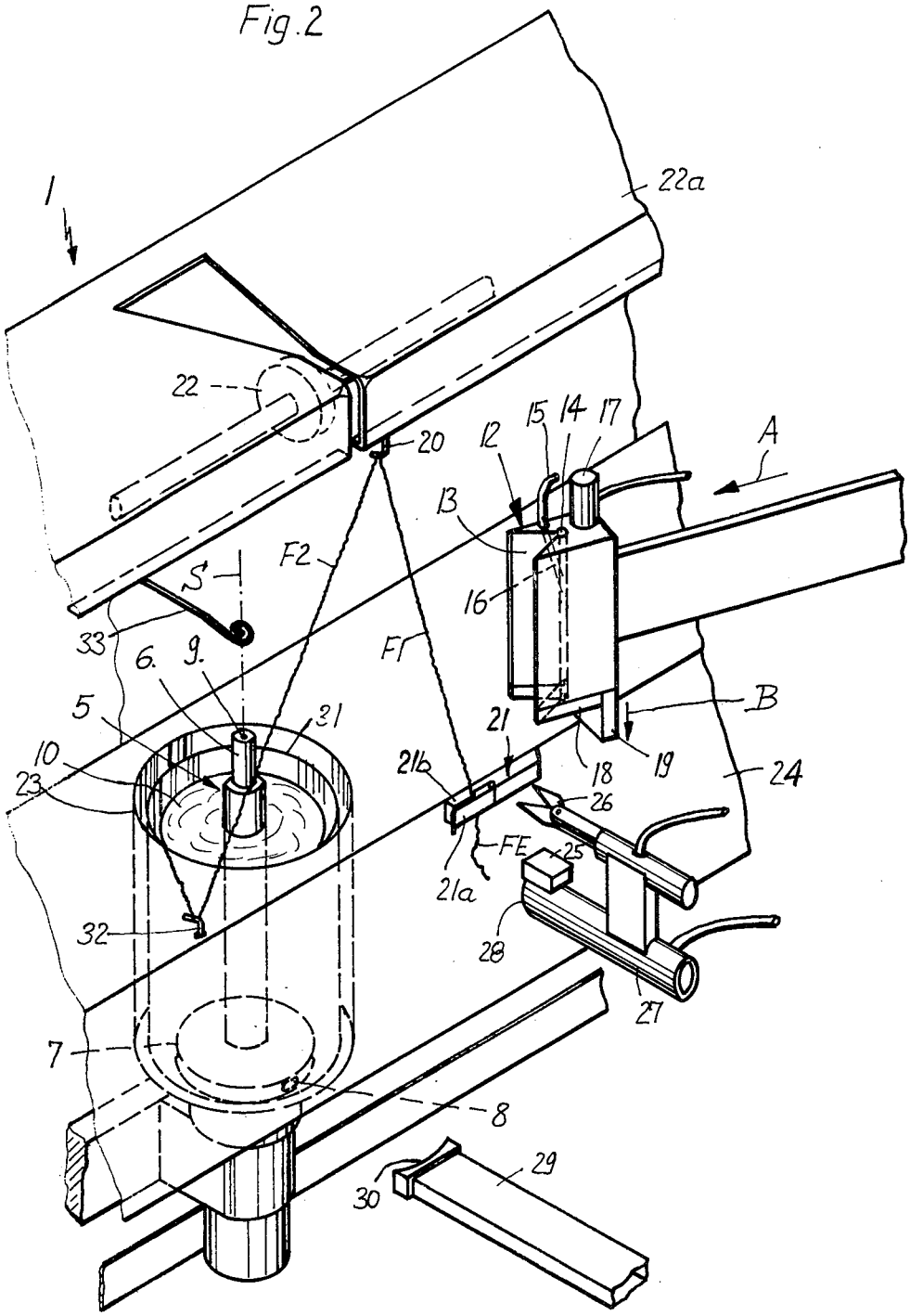
FIG. 2 shows diagrammatically a spindle with a presented thread and the parts of the threading device in rest position.
Figure 3:
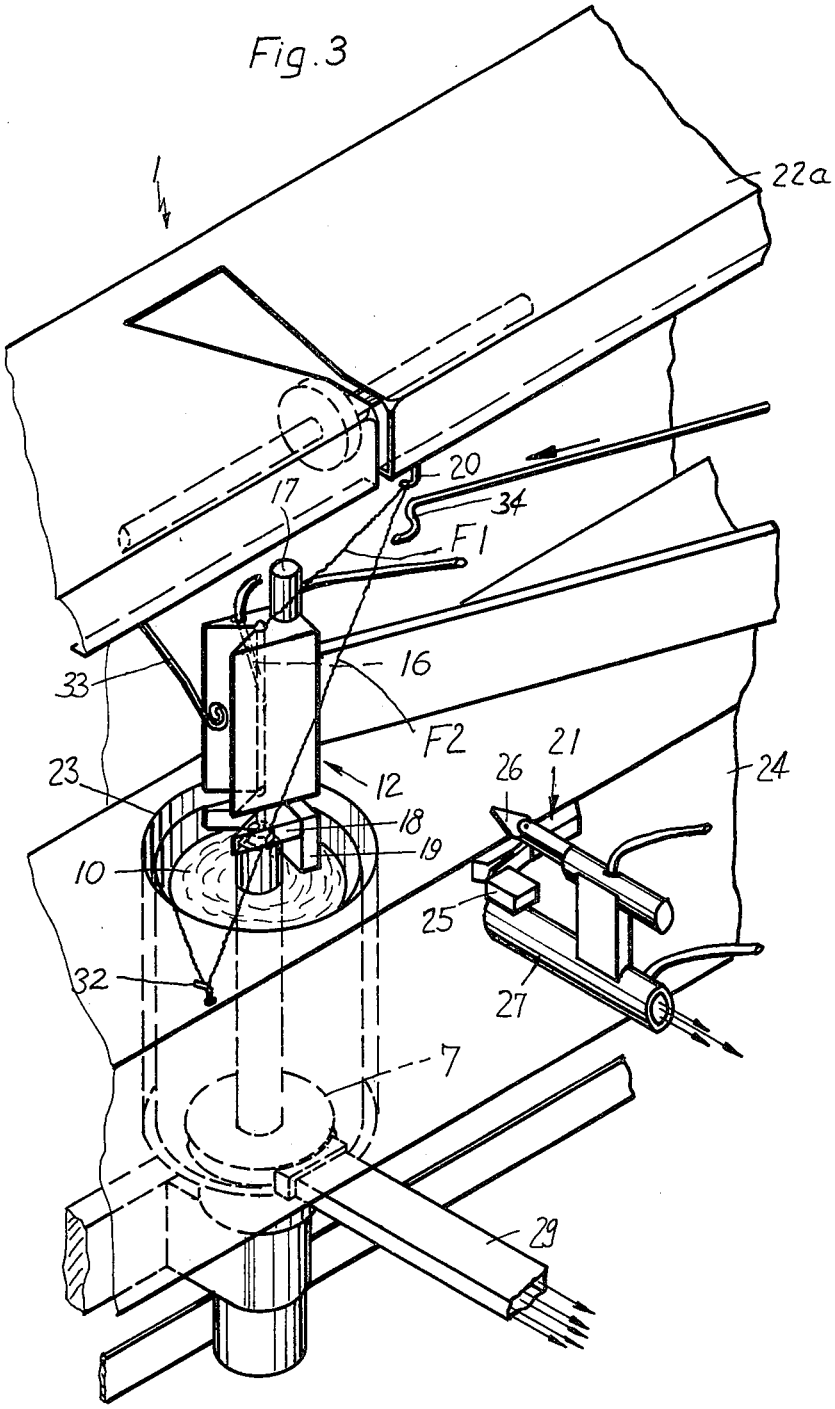
FIG. 3 shows diagrammatically these parts in the operative position.

This threading device has a threading head 12 driven by compressed air, which is movable in the direction A out of its rest position shown in FIG. 2 in which it is remote from the spindle to its operative position illustrated in FIG. 3. The threading head 12 may be arranged on a rectilinearly movable slide (not shown) which is driven by a compressed air cylinder. At its end facing the spindle axis S the threading head 12 has an inlet slot 13 that extends parallel to the spindle axis and which preferably widens in the direction of the spindle 5. The inlet slot 13 extends as far as a thread channel 14 provided in the threading head 12, this channel being parallel to the spindle axis S and registering in the operative position with the spindle axis. The threading head 12 is also connected to a compressed air pipe 15 which is connected to a blower nozzle 16 provided in the threading head 12. The blower nozzle 16 opens into the thread channel 14 and creates therein a downwardly directed air current. Instead of the blower nozzle an injector nozzle provided with a longitudinal slot may be provided. On the threading head 12 is further provided a slide, not shown in detail, which is movable downwardly in the direction B parallel to the spindle axis S, by means of the compressed air cylinder 17. This slide has at its lower end a slotted press-plate 18, the slot of which registers with an inlet slot 13. There may also be provided on the slide or on the press-plate 18 a downwardly projecting permanent magnet 19 which in the operative position of the threading head 12 is located laterally of the thread brake 6.

The threading device also includes at least two holder elements arranged on each spindle and spaced one above the other, and substantially in the plane of movement of the inlet slot 13. The upper holder element 20 advantageously consists of a hook opening towards the spindle axis S. This hook 20 is, in the example illustrated, secured to a casing **22*a* which is arranged in the region of the lead rollers 22. The lower holder element 21 is secured to a front closure wall 24 of the frame at about the level of the upper end of the ballon limiter 23. The lower holder element 24 is preferably constructed as a thread clamp having a movable clamp block 21*a*. This movable clamp block 21*a* cooperates with a permanent magnet 25**.

There is also provided in the region between the two holder elements 20 and 21, a shears 26 that can travel into the vicinity of the lower holder element, the shears being arranged on a slide (not illustrated) also located in the service carriage 4 and driven by means of a compressed air cylinder. To the shears 26 is preferably also connected a suction nozzle 27 the suction opening of which 28 is, in the operative position of the shears, arranged beneath the thread clamp 21. The suction nozzle 27 also carries the permanent magnet 25.

The threading device also includes a suction device 29, which is likewise arranged in the service carriage and the suction nozzle 30 of which is movable towards the storage disc 7. For mounting and driving this suction device 29 there may likewise serve a slide driven by means of a compressed air cylinder.

In the region of the upper edge of the ballon limiter 23, or the upper rim of the bobbin carrier protective box 31 if no ballon limiter is to be provided, there is preferably provided, on a stationary part of the frame, a second hook which is open towards the longitudinal medial plane of the frame, and which is arranged outside the plane of movement of the inlet slot 13 and so remote therefrom that a piece of thread F2 running between the two hooks 32 and 20 is held outside the range of movement of the threading head 12.

OPERATION

The operation of the threading device is as follows. If the attendant notices a breakage of thread between the supply bobbin 10 and the opening 8 of the storage disc 7, or if a thread is to be threaded anew into the spindle, he takes hold of the end of thread located in the region of the supply bobbin 10 and draws a length of thread from the supply bobbin 10. This length of thread is then hung on the hooks 32 and 20 and then drawn laterally between the movable clamp block 21*a* and the fixed clamp block 21*b* of the thread clamp 21. The thread end FE is held by the spring loaded clamp block 21 so that it plays no part however long this thread end FE is. The drawing off and hanging of the thread may be performed by the attendant regardless of the position of the service carriage at the time. Since this presentation of the thread takes only a relatively short time, one attendant can attend to several frames or be available for other work. The spindle does not need to be held for the application of the thread.

If now the service carriage 4 comes to a spindle with an applied thread, it is brought to a standstill by a suitable signal and positioned opposite the spindle. A device provided on the service carriage breaks the spindle itself and brings it to a standstill in a position in which the opening 8 of the storage disc 7 is directed towards the suction opening 30 of the suction device 29. While the spindle is positioned, the unit consisting of shears 26, suction nozzle 27 and permanent magnet 28 is moved into the operative position towards the thread clamp 21. When the suction nozzle 28 is close enough to the thread clamp 21 the free end FE of the thread is sucked into the suction nozzle 28. Upon further approach of the suction nozzle 28 the permanent magnet 25 opens the movable clamp block 21*a*. The presented thread is drawn therethrough by the suction nozzle. The special arrangement of the thread clamp 21 and of the hook 20 ensures that the applied length of thread F1 is located in the plane of the inlet slot 13. In contrast, the length of thread F2 is held by the hook 32 out of the path of movement of the threading head 12. The threading head 12 now moves towards the spindle axis S, the applied piece of thread F1 being guided through the inlet slot 13 into the thread channel 14. Now the shears 26 separate the thread and at the same time, or shortly before, compressed air is fed to the blower nozzle 16 via the pipe 15. The free end of the presented piece of thread F1 is held in the thread channel 14 by the air current issuing from the blower nozzle 16. The threading head 12 now moves further towards the spindle axis until the thread channel 14 is in register with the thread brake 6. The ballon guide 33 resiliently supported above the spindle is shifted laterally. The slide with the press-plate 18 is now moved downwardly by means of the compressed air cylinder 17, whereby the upper part of the thread brake 6 is shifted downwardly and the brake shoe is thereby released. This brake shoe is then moved laterally away from the spindle axis by the permanent magnet 19 and the thread is thereby allowed a free passage through the thread brake. The suction device 29 which in the meantime has been brought to the suction opening 8 begins to suck. In combination with the air current from the blower nozzle 17 the end of the piece of thread F1 is sucked into the opening 9 of the thread brake 6 and through the hollow spindle and the storage disc 7.

For assisting this operation there is preferably provided above the threading head 12 a stripper 34 that releases the presented length of thread F1 from the upper hook 20. The lower hook 32 is so shaped and directed that it allows the thread to slip as soon as it is no longer held by the upper hook 20. The spacing of the hooks 32, 20 and the thread clamp 21 is such that the free end of the piece of thread F1 can emerge from the opening 8 of the storage disc without a further length of thread needing to be drawn from the supply bobbin. By the cutting of the end of the thread FE by means of the cutter 26 an exact length of thread as required for the threading operation is always obtained.

After the threading operation is completed, all the elements of the threading device travel back into their rest positions. The suction device 29 holds the thread projecting out of the storage opening 8, so that upon further presentation of the thread it can conveniently be engaged by other elements (not illustrated) of the service carriage.

The embodiments of the invention in which an exclusive property or privilege is claimed are defined as follows:

1. In a threading device for double twist thread twisting frames, having a spindle and a storage disc, the improvement comprising a service carriage mounted for movement on and along at least one side of said frame, a suction device mounted on said service carriage and movable toward said storage disc, a compressed air driven threading head mounted on said service carriage and movable between a rest position remote from said spindle and a threading position in which it is in register with the upper end of said spindle, said threading head having on its side facing the spindle axis (S) an inlet slot that extends parallel to said spindle axis (S) and a thread channel adjacent the bottom of said inlet slot which in the threading position registers with said spindle axis (S), and at least two holder elements mounted on said frame and being spaced one above the other and substantially in the plane of movement of said inlet slot and between which a piece of thread (F1) to be threaded can be supported and thereby presented to said threading head.

2. The improved device according to claim 1, including shears mounted on said service carriage and supported for movement into and out of the region between said two holder elements adjacent the lower holder element.

3. The improved device according to claim 1, wherein the lower one of said holder elements includes thread clamp means.

4. The improved device according to claim 3, wherein said thread clamp means has a clamp block openable in response to the close positioning of a permanent magnet.

5. The improved device according to claim 4, including a suction nozzle connected to said shears, said suction nozzle having a suction opening which, in the operative position, is arranged beneath said thread clamp, said suction nozzle being connected to and movable with said permanent magnet magnetically cooperating with said clamp block.

6. The improved device according to claim 1, wherein the upper one of said holder elements is formed as a hook which opens towards said spindle axis.

7. The improved device according to claim 1, wherein said frame includes a ballon limiter and wherein there is provided in the region of the upper rim of said ballon limiter a further hook which opens towards a longitudinal medial plane of said frame, said hook being arranged outside the plane of movement of said inlet slot and spaced from it so far that a piece of thread (F2) running between said two holder elements is held outside the range of movement of said threading head.

8. The improved device according to claim 1, wherein there are provided on the threading head at least one blower nozzle which creates a downwardly directed air current in said thread channel.

9. The improved device according to claim 1, wherein said inlet slot widens in the direction of the spindle axis (S).

10. The improved device according to claim 1, wherein said spindle includes a thread brake and wherein there is provided on said threading head a downwardly movable slide which in the operative position of said threading head cooperates with said thread brake.

11. The improved device according to claim 10, wherein said slide has a slotted press-plate.

12. The improved device according to claim 10, wherein there is provided on said slide a downwardly projecting permanent magnet which in the operative position is located laterally of said thread brake.

13. The improved device according to claim 1, wherein said suction device includes a suction nozzle and is likewise arranged on said service carriage so as to be movable towards and away from said spindle.

14. The improved device according to claim 1, wherein there is provided above said threading head a stripper that releases the presented piece of thread (F1) from the upper one of said holder elements.

15. The improved device according to claim 1, wherein said spindle includes a thread brake with an opening therein, said threading head being movable into and out of registry with said opening.

* * * * *